US007086875B2

(12) United States Patent
Hoffmann

(10) Patent No.: US 7,086,875 B2
(45) Date of Patent: Aug. 8, 2006

(54) CURRENT-RAIL ADAPTER

(75) Inventor: Dieter Hoffmann, Sundern (DE)

(73) Assignee: Erco Leuchten GmbH, Ludenscheid (DE)

( * ) Notice: Subject to any disclaimer, the term of this patent is extended or adjusted under 35 U.S.C. 154(b) by 0 days.

(21) Appl. No.: 10/802,695

(22) Filed: Mar. 17, 2004

(65) Prior Publication Data

US 2004/0253856 A1 Dec. 16, 2004

(30) Foreign Application Priority Data

Mar. 18, 2003 (DE) ..... 103 12 066

(51) Int. Cl.
*H01R 25/00* (2006.01)

(52) U.S. Cl. ..... 439/119; 439/596; 439/906

(58) Field of Classification Search ..... 439/906, 439/731, 687, 596, 467, 165, 31, 640, 929, 439/328, 119
See application file for complete search history.

(56) References Cited

U.S. PATENT DOCUMENTS 3,519,978 A * 7/1970 Taormina et al. ..... 439/596
4,210,380 A * 7/1980 Brzostek ..... 439/456
4,702,975 A * 10/1987 Fields ..... 429/100
5,634,817 A * 6/1997 Siemon et al. ..... 439/608
5,879,203 A * 3/1999 Egle et al. ..... 439/830
6,074,238 A * 6/2000 DeRoss et al. ..... 439/409
RE37,092 E * 3/2001 Sharrah et al. ..... 439/929
6,761,589 B1 * 7/2004 Venditti et al. ..... 439/596

FOREIGN PATENT DOCUMENTS

DE 28 10 681 9/1979
DE 20116392 1/2002
EP 0 560 445 9/1993

* cited by examiner

*Primary Examiner*—Tho D. Ta
(74) *Attorney, Agent, or Firm*—Andrew Wilford

(57) ABSTRACT

A device (10) is shown and described for at least indirectly connecting a light fixture with a power track (11) and having a housing (38) holding at least one angularly movable control shaft (21 or 22) and formed of at least two housing shells (34*a* and 34*b*) formed of dielectric material, in particular plastic.

The novelty is that at least a first housing shell (34*b*) is provided with a retaining formation (36*a*, 36*b*, 36*c*, 36*d*, 36*e*, 36*f*, or 36*g*) that cooperates with the control shaft (21 or 22) and/or with a second housing shell (34*a*).

17 Claims, 7 Drawing Sheets

Stand der Technik

CURRENT-RAIL ADAPTER

The invention relates to a device for at least indirectly connecting a light fixture with a power track according to the introductory clause of claim 1.

A device for at least indirectly connecting a light fixture with a power track is generally called a power-track adapter. A number of axially shiftable light fixtures can be mounted in a power track in a simple manner.

A prior-art power-track adapter of the instant application is described in German 2,810,681. This adapter has been produced unchanged by the applicant for about 25 years and is used widely.

The known adapter is comprised of a number of parts and is expensive to assemble. The housing is formed of three shell elements that are secured together by conventional screws. Inside the housing there is a first and a second control shaft. The first control shaft is pivotal through an angle of 90° and has a pair of retaining tabs as well as a neutral contact. The second control shaft is pivotal through 180° and has a live contact. Between the two control shaft there is a latch G that acts as an mutual controller that prevents misuse.

The object of the invention is to improve on the power-track adapter known from German 2,810,681 according to the introductory clause of claim 1 so as to simplify its assembly.

The invention attains this object with the features of claim 1 in particular with those of the characterizing clause, and is thus characterized in that in that at least a first housing part is provided with a retaining formation that cooperates with a control shaft and/or with a second housing part.

The principle of the invention is thus basically the provision of retaining formations that for example work like clips and that have a retaining function.

For example retaining formations of a first type can be provided that are mounted on a first housing shell and that cooperate with respective retaining surfaces on another housing shell. In this manner one can dispense with threaded screws of which three are used in the prior art. Even the hitherto difficult insertion of the screws is eliminated. A simple clipping together of the housing parts, in particular two parts, makes the housing as simple as possible to assemble.

In particular in this manner it is possible to used an at least partially automated assembly, since the retaining formations can be formed as snap-type fasteners that are snapped together by an automated movement of the two housing parts together.

According to a further feature of the invention the retaining formations can also serve to cooperate with the control shaft. The power-track adapter that can also be made exactly the same as or differently with regard to internal parts and function from the known power-track adapter described in German 2,810,681, has a first and a second control shaft that are pivotal in the housing.

With the known power-track adapter the first and second control shafts are set one after the other in the housing. Then further elements, in particular the latch, are mounted inside the housing. Finally hookup wires that connect to the light fixture are secured to the appropriate terminals. Since the shafts are merely resting in place, this connection work is fairly tricky.

According to the invention it is possible as a result of the provision of at least one retaining formation to provide a secured position for the first and/or second control shaft. The secured position is signaled to the user audibly, as a click, and confirms that the desired secured position is reached.

The control shaft can pivot when in the secured position so that the retaining formations do not interfere with the functions of the control shafts.

In addition the secured position makes it possible if desired to for example use an automated conveyor of the housing parts with the control shafts mounted in them without there being any danger that the control shafts are inadvertently knocked out of the housing parts. Handling is thus substantially simplified so that overall assembly is also simpler.

Preferably the seat for the control shaft also axially fixes the control shaft so that a hookup wire for a light fixture can be connected via a plug connection by moving the free end of the hookup wire axially into engagement with a contact in the control shaft.

According to a further advantageous embodiment of the invention a first type of retaining formation is provided that cooperates with the control shaft and a second type of retaining formation is provided that cooperates with the second housing part. With this embodiment of the invention assembly is made even easier.

According to a further advantageous embodiment of the invention the retaining formation is made unitarily of one piece with the housing shell. More particularly, when the housing is injection molded of plastic the retaining formations are formed is with it so that the manufacturing cost of the retaining formations are minimal.

According to a further advantageous embodiment of the invention the retaining formation is elastically deformable. This makes for a particularly simple construction since additional parts are not needed.

According to a further advantageous embodiment of the invention the retaining formation is formed as a spring tongue. This facilitates even simpler construction in that the spring tongue projects away from a aback wall of the housing shell. The axial length of the spring tongue can created the desired elasticity of the retaining formation.

According to a further advantageous embodiment of the invention the housing is formed as two housing halves that are connected together by a membrane hinge. This further simplifies manufacture and handling since the one-piece housing can also be closed by a machine by pivoting the two housing halves relative to each other together into the closed position. As this happens a plurality of retaining formations in the first housing half coact with respective retaining surfaces on the second housing half.

According to a further advantageous embodiment of the invention the retaining surfaces are provided adjacent apertures in the wall of the housing part. This makes possible a particularly efficient and material-economizing formation of the retaining surfaces and retaining formations. In addition in this manner the retaining formations remain accessible even when the housing is closed and make it possible for example to open the housing with a tool.

According to a further advantageous embodiment of the invention the first-type retaining formation engages around the control shaft, at least partially fitting around an outer surface of the retaining shaft. With this embodiment of the invention a particularly simple securing of the control shaft in the housing part is ensured.

According to a further advantageous embodiment of the invention at least a pair of first-type retaining formations are provided to hold the control shaft. In this simple manner forces are distributed optimally.

Further advantages are seen in the uncited dependent claims with reference to the following description of an embodiment shown in the figures. In the drawing:

It is noted that in the following specific description the same or similar parts or elements are assigned the same references for clarity's sake, partly with the addition of lower-case letters.

Figure 1:
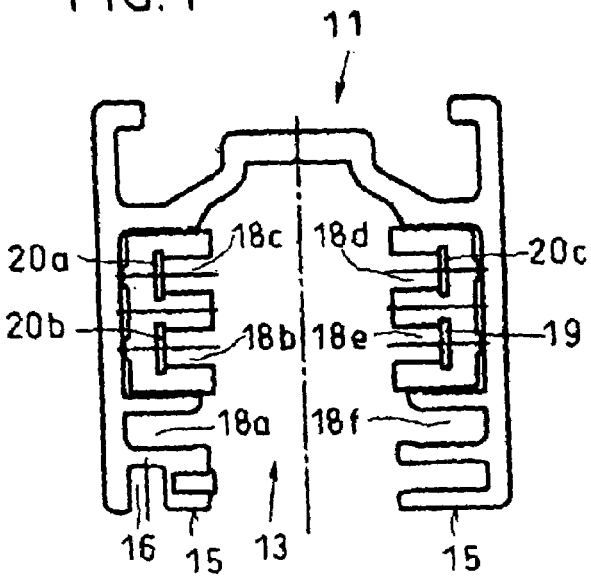
FIG. 1 is a schematic view showing the profile of a prior-art power track.

The device shown generally in the figures at 10 serves for connection of an unillustrated light fixture with a standard power track shown in FIG. 1 at 11. Such a power track is secured in a structure, for example on a ceiling, and receives an insert part 12 (FIG. 2) of the device 10. The device 10 corresponds in its external dimensions and in its internal structure at least as regards functionality to that described in German 2,810,681, there described as a power-track adapter by the applicant.

With the risk of possible repetition in the following the functioning of the device 10 is described.

The power track 11 has a slot 13 which receives the insert part 12 of the device 10. The device 10 is to this end inserted all the way into the slot 13 until an abutment face 14 of the device 10 bears on or is closely juxtaposed with a lower face 15 of the power track 11. In order to prevent incorrect positioning, the power track 11 has a locater groove 16 in which locater elements 17 provided at the abutment face 14 of the device 10 can engage.

The power track 11 has a plurality of grooves 18*a*, 18*b*, 18*c*, 18*d*, 18*e*, and 18*f* serving as retaining grooves (e.g. 18*a* and 18*f*) or as contact grooves. The grooves 18*b* ,18*c*, 18*d*, and 18*e* are provided with conductors. The conductor 19 is a neutral conductor and the remaining conductors are live conductors 20*a*, 20*b*, and 20*c* as known in the art.

The device 10 serves for the electrical connection and normally also for the mechanical mounting of a light fixture not shown in the drawing on the power track 11. In order to mechanically mount the light fixture there is a screw connection in a mounting region 37 of the device 10, for example by screwing or clamping of an unillustrated mounting element of the light fixture. It is also known to secure special-duty mounts, like holders, on the mounting region 37 of the device 10.

To electrically connect the light fixture with the conductors 19, 20*a*, 20*b*, and 20*c*, unillustrated wires of the fixture pass through the mounting part 37 of the device 10 into the housing 38 of the device 10. Inside the housing 38 is a first control shaft 21 (FIG. 3) and a second control shaft 22. Each of the two control shafts 21 and 22 is pivotal about a respective pivot axis 23. The first control shaft 21 is pivotal through about 90° and to this end has an actuating arm 34 projecting outside the housing 38 and serving for manual actuation. In order to pivot the second control shaft 22 that is pivotal generally through an angle of about 180° it has on its lower end as shown in FIG. 3 entrainment formations 25 shaped like teeth that allow easy manual gripping.

Figure 3:
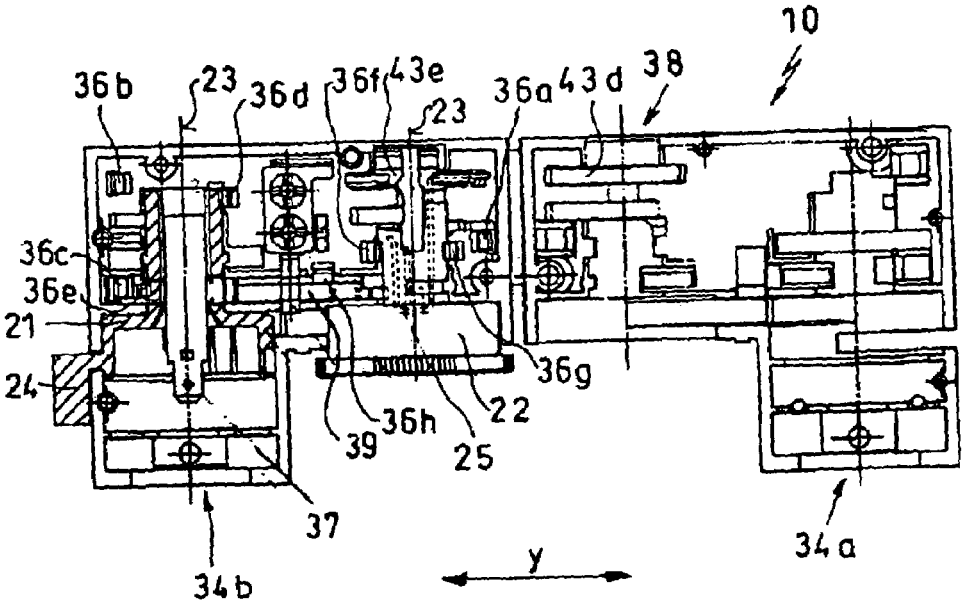
FIG. 3 is a partial section showing the interior of the device according to the invention from FIG. 2, the two housing halves being opened up.

A latch member 39 is provided according to FIG. 3 generally centrally of the two control shafts 21 and 22 and interconnects them.

The first control shaft 21 has a neutral contact 26 that projects radially of the pivot axis 23 of the control shaft 21. In addition there are two retaining tabs 27*a* and 27*b* serving for mechanical holding.

The first control shaft 21 has a head portion 29, a central portion 30, and a foot portion 31. The head and central portions have generally the same outside diameter while the outside diameter of the foot portion is substantially larger. The first control shaft 21 is generally hollow and has central throughgoing passages 40*a* and 40*b*.

Figure 11:
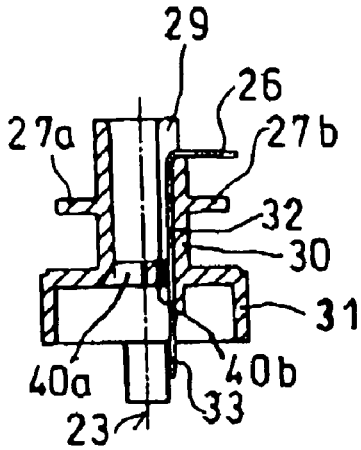
FIG. 11 is the first control shaft in sectional view along line XI—XI of FIG. 10.

The neutral contact 26 is part of a contact strip 32 that is formed by bending a stamped-out piece of sheet copper. At its lower end as shown in FIG. 11 the contact strip 32 has a male contact terminal 33 that serves for connection with a flat female terminal sleeve of an unillustrated wire of the light fixture.

Figure 12:
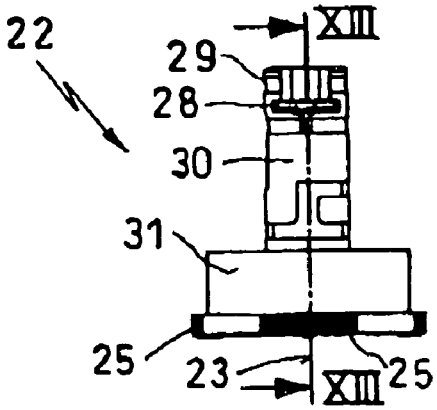
FIG. 12 is a side detail view of the second control shaft of FIG. 3.
Figure 13:
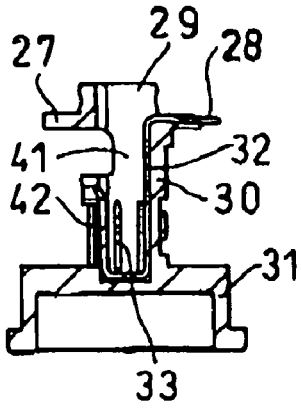
FIG. 13 is the second control shaft in sectional view along line XIII—XIII of FIG. 12.

The second control shaft 22 according to FIGS. 12 and 13 has a hot contact 28 that, as in the control shaft 21, projects radially outward from the pivot axis 23. The hot contact tab 28 is part of a contact strip 32 that also is formed of stamped sheet copper. The contact strip 32 of the second control shaft is in a compartment 41 and has a mounting portion 42 that holds the contact strip 32 in place. A male contact terminal 33 projects as shown in FIG. 3 upward and is directed generally along the pivot axis 23. The male terminal 33 serves for electrical connection with an unillustrated flat female terminal sleeve of an unillustrated hookup wire.

The second control shaft 22 also is subdivided into a head portion 29 and a central portion 30 that are substantially smaller than a foot portion 31.

The first control shaft 21, like the control shaft 22, is in a nonuse position prior to insertion of the insert portion 12 into the insert slot 13. The retaining tabs 27*a* and 27*b* and the neutral contact 26 as well as the contact 27 and the hot contact 28 of the second control shaft 22 are retracted inside the housing 38 in this position.

After fitting the device 10 into the insert slot 13, the first control shaft 21 is pivoted by actuation of the arm 24 through about 90° about its pivot axis so that the retaining tabs 27*a* and 27*b* and the neutral contact 26 extend out through respective slits 43*a*, 43*b*, and 43*c* from the housing 38. The retaining tabs 27*a* and 27*b* project into the respective retaining grooves 18*a* and 18*f* while the neutral contact 26 engages into the respective neutral contact groove 18 for engagement with the neutral conductor 19. The first control shaft 21 is thus in its use position.

The latch member 39, which is shiftable axially as shown by double-headed arrow y in FIG. 3, is moved by an unillustrated outwardly open circumferential groove of the first control shaft 21 into a position in which it permits pivoting of the second control shaft from its nonuse position.

It should be noted that when the first control shaft is in its nonuse position pivoting of the second control shaft 22 out of its rest position is not possible since the latch member 39 locks it. The latch member can be formed for example as described in German 2,810,681.

When the second control shaft 22 is displaced out of its nonuse position into a use position, three different use positions can be reached. According to whether the second control shaft 22 is moved as shown in FIG. 3 from its nonuse position through 90° clockwise or counterclockwise, the first or second use position will be reached in which the hot contact 28 either projects out of an upper housing slit 43*d* or a lower housing slit 43*e*. The retaining tab 27 of the second control shaft will extend out of the other housing slot 43*e* or 43*d*.

Alternatively it is possible to shift the second control shaft 22 axially downward as shown in FIG. 3 so that a further pivoting through 90° takes place to move the hot contact 28 out through the housing slit 43*f*. In this case the retaining tab 27 projects out of the housing slit 43*g*.

Further disclosure of the object of the invention is found in applicant's jointly filed parallel U.S. Pat. application No. 10/802,698 whose disclosure is herewith incorporated by reference.

Figure 5:
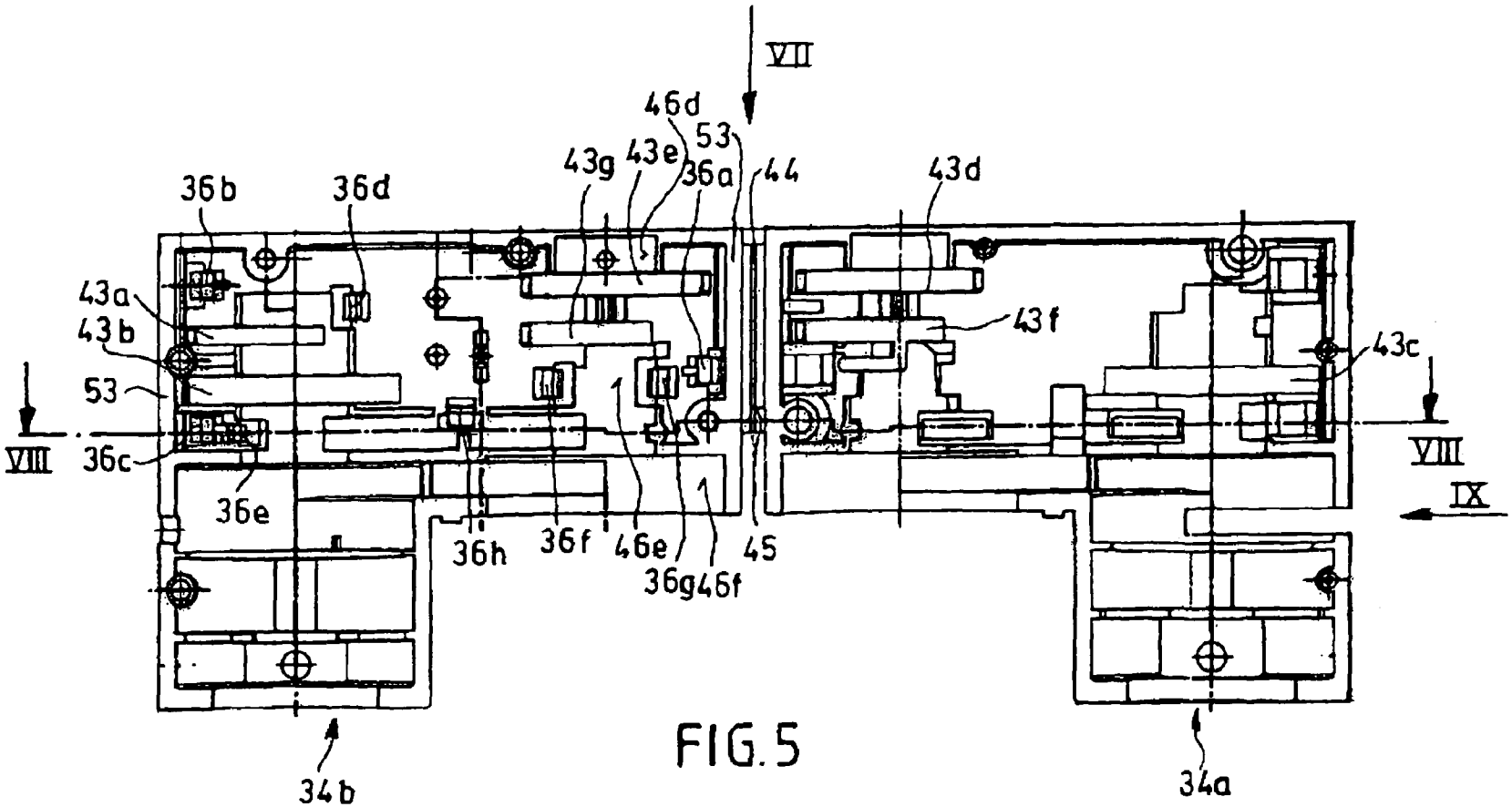
FIG. 5 is the device according to FIG. 4 in enlarged view.
Figure 6:
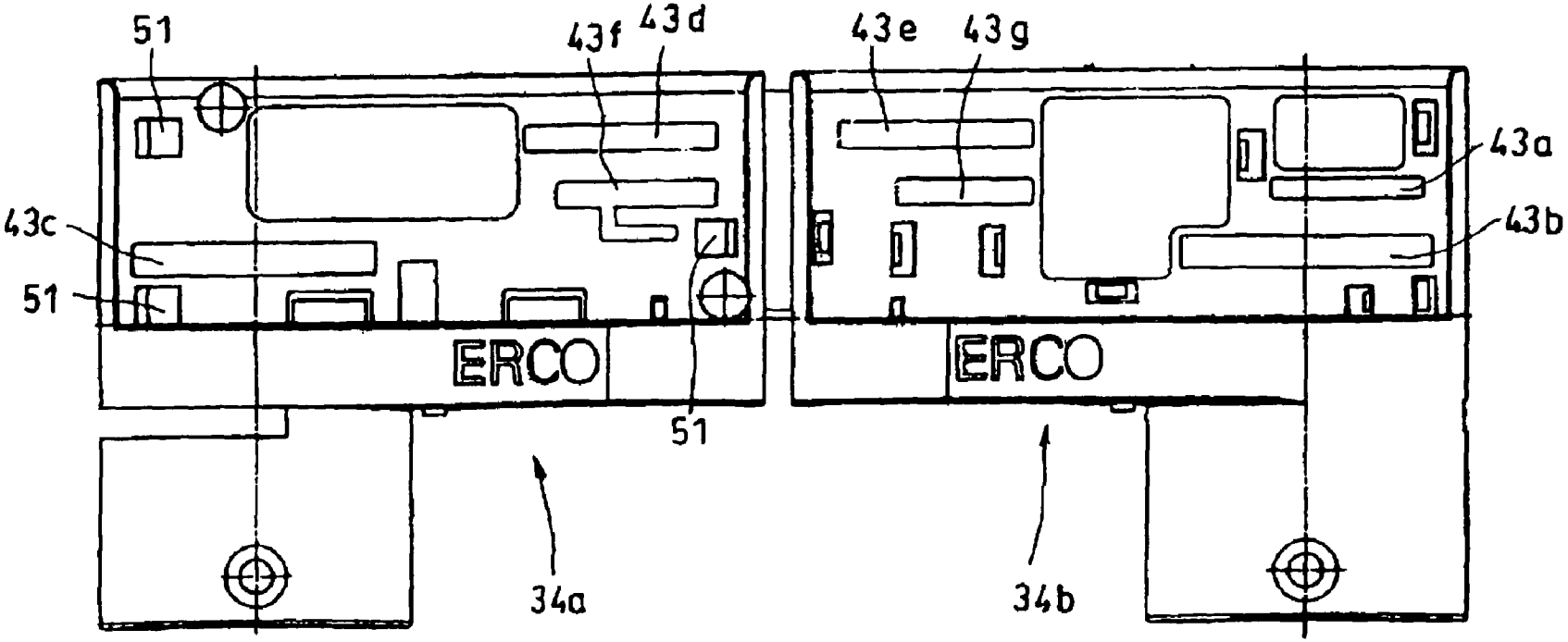
FIG. 6 is the device of FIG. 5 in back view.

The housing 38 is comprised as shown clearly in FIG. 5 of two housing halves 34*a* and 34*b* formed as shells. The two housing halves 34*a* and 34*b* are connected to each other by a membrane hinge 44 and thus are unitary with each other.

Figure 2:
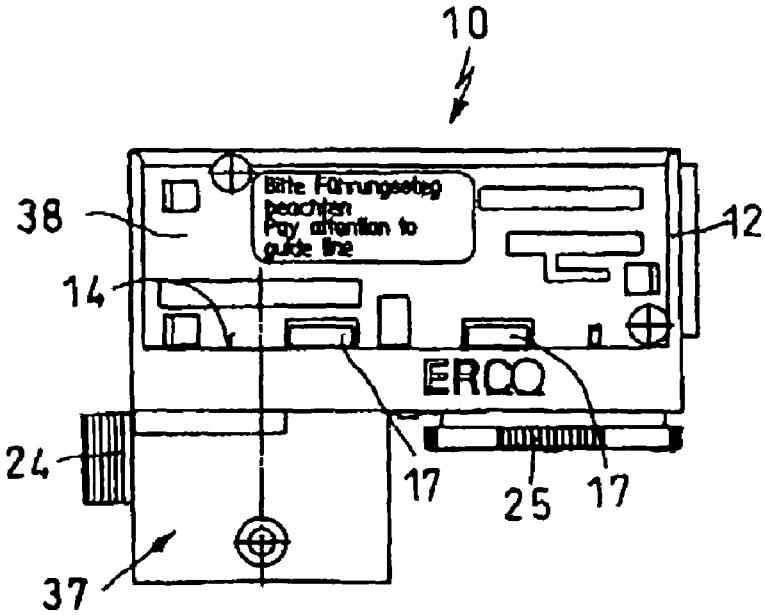
FIG. 2 is schematic view of an embodiment of the device according to the invention in assembled condition.

Pivoting the right-hand housing half 34*a* as shown in FIG. 5 about a pivot axis 45 defined by the membrane hinge 44 upward from the view plane of FIG. 5 and then against the left-hand housing half 34*b* as shown in FIG. 5 puts the housing 38 in the assembled condition shown in FIG. 2.

Figure 4:
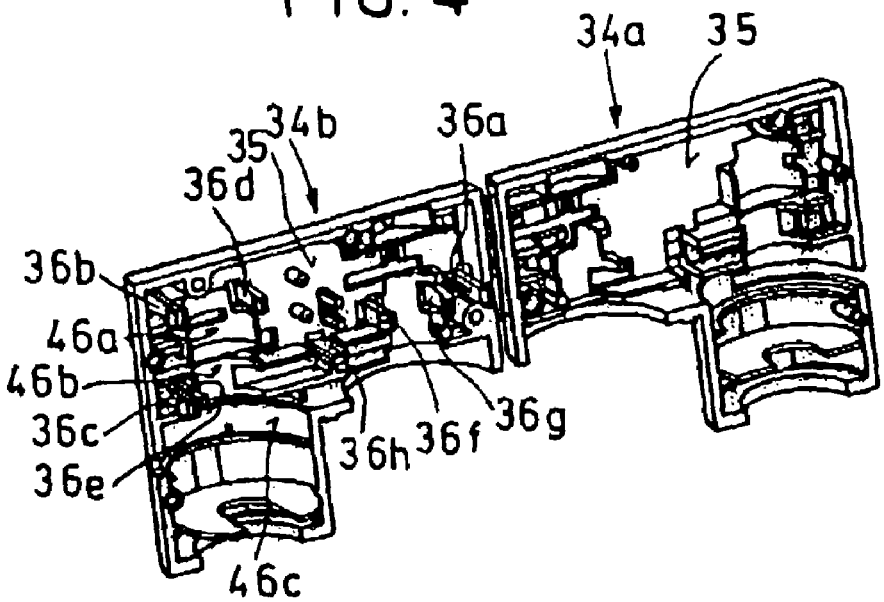
FIG. 4 is a perspective view of the device in opened-up condition without the two control shafts.

As shown for example in FIGS. 4 and 5, the housing halves 34*a* and 34*b* each have a back wall 35 from which project several formations. There are for example webs 46*a*, 46*b*, and 46*c* that form a journal for the first control shaft 21. Similarly there are webs 46*d*, 46*e*, and 46*f* that form a journal for the second control shaft 22.

The novelty of this device 10 is that a plurality of retaining formations 36*a*, 36*b*, 36*c*, 36*d*, 36*e*, 36*f*, 36*g*, and 36*h* are provided. Each of the retaining formations 36*a*, 36*b*, 36*c*, 36*d*, 36*e*, 36*f*, 36*g*, and 36*h* is elastically deformable.

Figure 8:
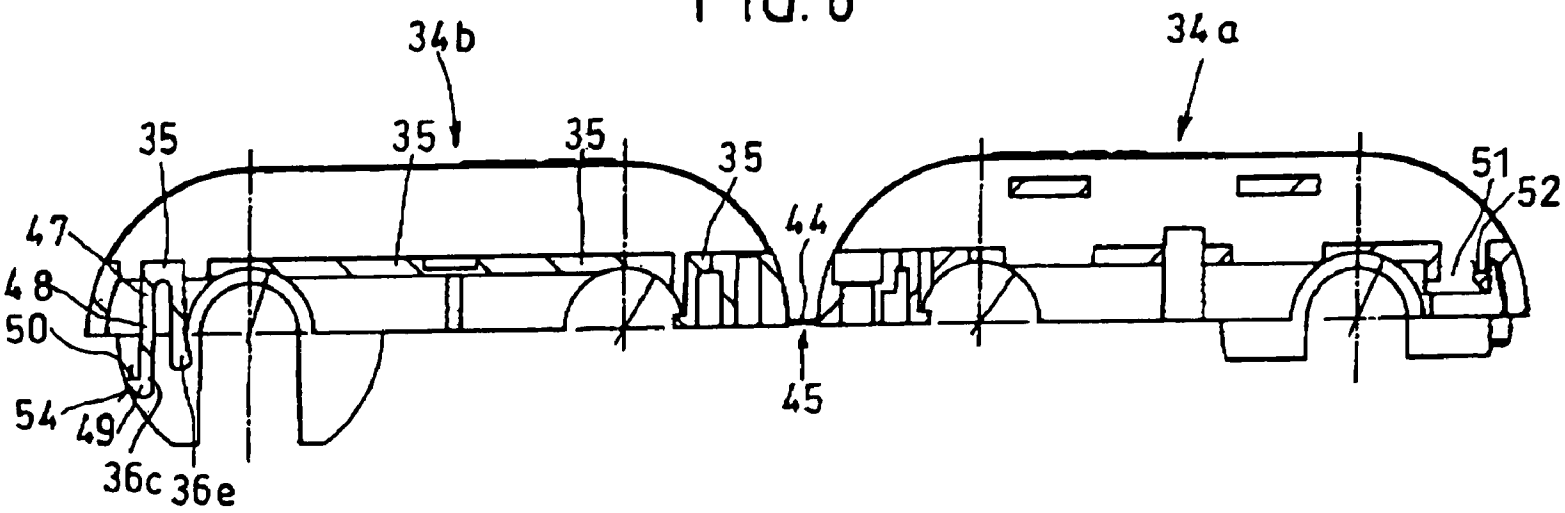
FIG. 8 is the device in partly sectional schematic view according to section line VIII—VIII of FIG. 5.

The retaining formation 36*c* is described by way of example with reference to FIG. 8. It is connected by a mounting portion 47 to the back wall 35 of the housing half 34*b*. An axially elongated portion 48 ends in an end hook 49 that has a surface 50.

As a result of the relatively long and thin construction of the portion 48, the end 49 is elastically deflectable perpendicular to the view plane about a pivot axis extending through the mounting portion 47.

In the right-hand housing half 34*b* as shown in FIG. 8 there is an aperture 51 having a retaining surface 52. When the two housing halves 34*a* and 34*b* are pivoted together about the axis 45, a cam face 54 of the end hook 49 is deflected through the aperture 51 until the hook face 50 snaps back onto the retaining surface 52 and permanently locks the two housing halves 34*a* and 34*b* together.

Although not strictly necessary, it might be desired to angle the hook face 50 and the retaining surface 52 such that when a sufficiently large peak force is applied the retaining formation 36*c* releases so that the housing 38 can open up.

In order to secure the two housing halves 34*a* and 34*b* to each other, in addition to the retaining formation 36*c* there is also in an edge region 53 of the housing 38 a retaining formation 36*b* and a retaining formation 36*a*, the latter being adjacent the edge 53 at the membrane hinge 44. Overall there are thus three retaining formations 36*a*, 36*b*, and 36*c* that are generally identical and that together latch the two housing halves 34*a* and 34*b* together. Apertures shown at 51 are also provided for the retaining formations 36*a* and 36*b*.

The retaining formations 36*a*, 36*b*, and 36*c* are considered to be of the second type. In addition the device 10 has first-type retaining formations 36*d*, 36*e*, 36*f*, and 36*g* as well as a third-type retaining formation 36*h*. The third-type retaining formation 36*h* is similar to the retaining formations 36*a*, 36*b*, and 36*c* and serves for securing the latch 39. This is not described in more detail here.

The first-type retaining formations serve for securing the control shafts 21 and 22.

The pair of adjacent retaining formations 36*f* and 34*g* serve for securing the second control shaft 22 and engage an outer surface of the central portion 30 of the second control shaft 22.

Figure 7:
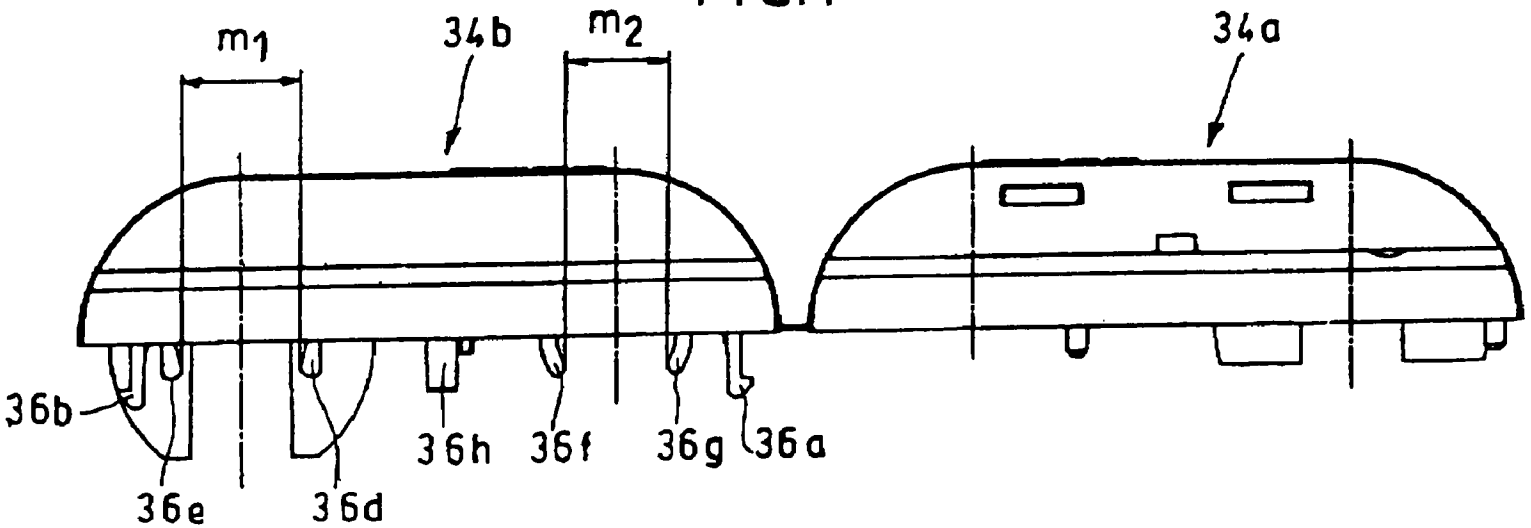
FIG. 7 is the device according to view arrow VII of FIG. 5.
Figure 9:
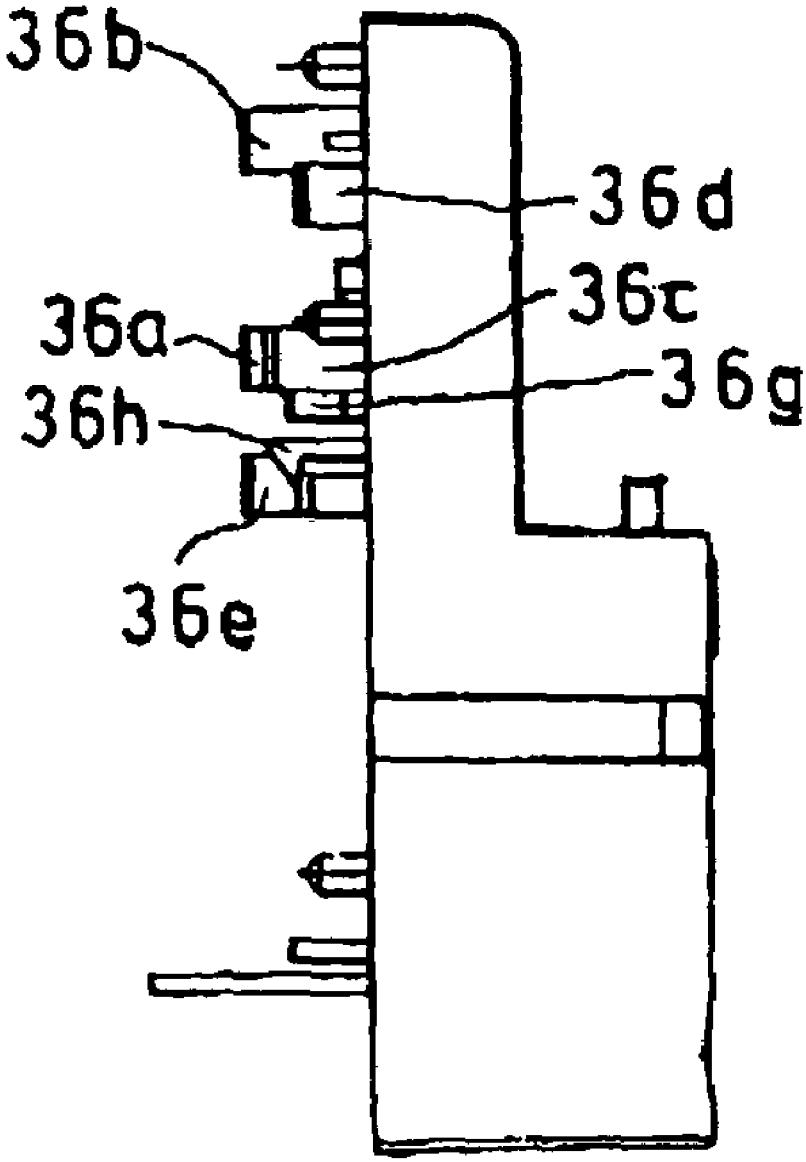
FIG. 9 is the device according to view arrow IX of FIG. 5.
Figure 10:
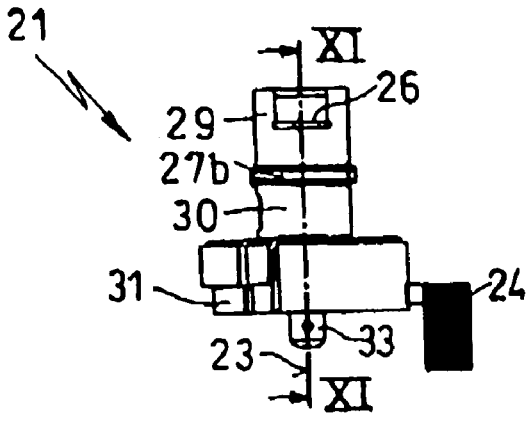
FIG. 10 is the first control shaft according to FIG. 3 in detail view.

The retaining formations 36*f* and 36*g* are as partially shown in FIG. 7 shaped as forks and engage in the secured position of FIG. 3 around the control-shaft central portion 30.

The retaining formation 36*d* as well as the second-type retaining formation 36*e* shown below it in FIG. 3 serve for securing the first control shaft 21 on the housing 38. The two retaining formations 36*d* and 36*e* engage around the outside of the first control shaft 21 like a fork but are axially offset from one another. Thus the retaining formation 36*d* engages the head region 29 and the retaining formation 37*e* the central portion 30 of the first control shaft 21.

When the first control shaft 21 or the second control shaft 22 is installed in its secured position of FIG. 3, the retaining formations 36*d*, 36*e*, 36*f*, and 36*g* are spread so that their respective spacings $m_1$ and $m_2$ are increased as the portions 29 and 30 of the respective control shafts 21 and 22 are fitted to them. As soon as the control shafts 21 and 22 are fitted to them, they are secured in the housing 38. The housing 38 can then for example by moved about and even shaken or pivoted without the control shafts 21 and 22 dropping out of the housing 39.

In this manner it is possible for example to use an automated conveyor as part of an automated assembly operation.

Handling during assembly of the device 10 is thus considerably simplified and an at least partially automated assembly is possible. Finally, hooking up the terminals 33 to the unillustrated feed wires of the light fixture adds to this as they are accessible in the control shafts 21 and 22 in the housing 38.

The first-type retaining formations are constructed such that they securely hold the control shafts 21 and 22. The seated position is reached with a distinct sound, for example a click that is audible to the user.

The first-type retaining formations are also formed such that they do not inhibit rotation of the first and second control shafts 21 and 22. They form, on the contrary, a journal for the control shafts 21 and 22.

What is claimed is:

1. An adapter fittable with a power track having grooves holding conductors, the adapter comprising:

a first dielectric housing shell;

webs on the first shell forming a journal;

a control shaft fittable and rotatable in the journal and having a retaining surface;

means including an elastically deformable formation on the first shell engageable with the retaining surface for releasably retaining the shaft in the journal;

a second dielectric housing shell fittable with the first shell; and means for securing the shells together with the shaft between them.

2. The power-track adapter defined in claim 1 wherein the formation is a fork having a pair of elastically deformable arms between which the shaft is resiliently held and between which the shaft can rotate.

3. The power-track adapter defined in claim 1 wherein the retaining formation is two such forks.

4. The power-track adapter defined in claim 1 wherein the control shaft can rotate freely in the journal.

5. The power-track adapter defined in claim 1, further comprising a hinge between the shells.

6. The power-track adapter defined in claim 5 wherein the hinge is a membrane shell unitarily formed with the first and second shells.

7. The power-track adapter defined in claim 1 wherein the second shell has a retaining surface, the adapter further comprising a retaining formation on the first shell and snugly engageable with the retaining surface of the second shell.

8. The power-track adapter defined in claim 7 wherein the retaining formation of the first shell is a spring tongue having a hook end, the second shell being formed with a throughgoing aperture immediately adjacent the respective retaining surface, the shells being fittable together with the hook end engaging through the aperture and locking on the retaining surface of the second shell.

9. The power-track adapter defined in claim 7 wherein the retaining formation of the first shell is unitarily formed with the first housing shell.

10. The power-track adapter defined in claim 9 wherein the retaining formation of the first shell is elastically deformable.

11. An adapter adapted to fit with a power track having grooves holding conductors, the adapter comprising:

a first dielectric housing half shell;

a second dielectric housing half shell fittable with the first half shell and having a retaining surface;

formations on the half shells forming a journal;

a control shaft fittable in the journal between the half shells; and a retaining formation unitarily formed on the first half shell and latchingly engageable with the retaining surface of the second half shell.

12. The power-track adapter defined in claim 11 wherein the two housing half shells together form a substantially closed chamber containing the shaft.

13. The power-track adapter defined in claim 11 wherein the journal-forming formations are webs unitarily formed with the half shells and forming generally semicircular seats that in turn form the journal.

14. An adapter adapted to fit with a power track, the adapter comprising:

a first dielectric housing shell;

a second dielectric housing shell fittable with the first shell and having a retaining surface and formed with a throughgoing hole adjacent the retaining surface;

a control shaft fittable between the shells and having a retaining surface; and a retaining formation unitarily formed on the first shell and latchingly engageable through the hole with the retaining surface of the second shell.

15. An adapter adapted to fit with a power track, the adapter comprising:

a first dielectric housing shell;

a second dielectric housing shell fittable with the first shell and having a retaining surface;

a membrane hinge unitarily formed with and pivotally interconnecting the housing shells;

a control shaft fittable between the shells; and a retaining formation on the first shell and snugly engageable with the retaining surface of the second shell.

16. The adapter defined in claim 15 wherein the retaining formation is unitarily formed with the first shell.

17. The adapter defined in claim 15 wherein the retaining formation is immediately adjacent the membrane hinge.

* * * * *